US010837125B2

(12) United States Patent
Ohrtman, Jr.

(10) Patent No.: US 10,837,125 B2
(45) Date of Patent: Nov. 17, 2020

(54) MACHINE AND PROCESS FOR DECORTICATING PLANT MATTER

(71) Applicant: Franklin D Ohrtman, Jr., Denver, CO (US)

(72) Inventor: Franklin D Ohrtman, Jr., Denver, CO (US)

( * ) Notice: Subject to any disclaimer, the term of this patent is extended or adjusted under 35 U.S.C. 154(b) by 0 days.

(21) Appl. No.: 16/387,838

(22) Filed: Apr. 18, 2019

(65) Prior Publication Data

US 2019/0323148 A1 Oct. 24, 2019

Related U.S. Application Data

(60) Provisional application No. 62/659,484, filed on Apr. 18, 2018.

(51) Int. Cl.

| | |
|---|---|
| ***D01B 1/22*** | (2006.01) |
| ***D01B 1/44*** | (2006.01) |
| ***D01B 1/24*** | (2006.01) |
| ***D01B 1/14*** | (2006.01) |
| *D01B 1/46* | (2006.01) |
| *D01B 5/00* | (2006.01) |

(52) U.S. Cl.

CPC ..... *D01B 1/22* (2013.01); *D01B 1/14* (2013.01); *D01B 1/24* (2013.01); *D01B 1/44* (2013.01); *D01B 1/46* (2013.01); *D01B 5/00* (2013.01)

(58) Field of Classification Search

CPC ... D01B 1/10; D01B 1/14; D01B 1/22; D01B 1/24; D01B 1/28; D01B 1/34; D01B 1/44

See application file for complete search history.

(56) References Cited

U.S. PATENT DOCUMENTS

| | | | | | |
|---|---|---|---|---|---|
| 420,575 | A * | 2/1890 | Hartshorn | D01B 1/22 | 19/30 |
| 1,308,376 | A | 7/1919 | Schlichten | | |
| 1,447,450 | A * | 3/1923 | Wessel | D01B 1/22 | 19/29 |
| 1,709,001 | A * | 4/1929 | Booth | D01B 1/22 | 19/31 |
| 1,722,110 | A * | 7/1929 | Pritchard | D01B 1/22 | 19/24 |
| 1,807,221 | A * | 5/1931 | McCaw | D01B 1/22 | 19/29 |
| 1,855,941 | A * | 4/1932 | Cookson | D01B 1/22 | 19/28 |
| 2,215,050 | A * | 9/1940 | Nicholas | D01B 1/22 | 19/12 |
| 2,264,236 | A * | 11/1941 | Bokum | D01B 1/22 | 19/24 |
| 2,356,000 | A * | 8/1944 | Patterson | D01B 1/22 | 19/31 |
| 2,480,602 | A * | 8/1949 | Patterson | D01B 1/22 | 19/30 |
| 2,576,406 | A * | 11/1951 | McCrae | D01B 1/14 | 19/12 |

(Continued)

*Primary Examiner* — Shaun R Hurley

(74) *Attorney, Agent, or Firm* — Leyendecker & Lemire

(57) ABSTRACT

A decorticating machine comprising modular drum assemblies of different tooth and surface patterns that are installed between pairs of left and right lower and upper rails is described. The modular drum assemblies (usually provided in upper and lower drum pairs) and the number thereof can be chosen based on the particulars of the type of stalk being processed.

20 Claims, 13 Drawing Sheets

(56) References Cited

U.S. PATENT DOCUMENTS

| | | | | | |
|---|---|---|---|---|---|
| 2,719,332 | A * | 10/1955 | Short | D01B 1/14 | 19/24 |
| 2,835,928 | A * | 5/1958 | Johnson | D01B 1/22 | 19/31 |
| 5,465,464 | A * | 11/1995 | Chen | D01B 1/22 | 19/24 |
| 5,720,083 | A * | 2/1998 | Leduc | D01B 1/16 | 19/24 |
| 5,906,030 | A * | 5/1999 | Leduc | D01B 1/22 | 19/24 |
| 9,080,257 | B2 * | 7/2015 | Lupien | D01B 1/30 | |
| 9,957,642 | B2 * | 5/2018 | Dyas | D01B 1/30 | |
| 2007/0044890 | A1 * | 3/2007 | Sherwood | A01D 82/02 | 156/62.2 |

* cited by examiner

MACHINE AND PROCESS FOR DECORTICATING PLANT MATTER

RELATED APPLICATIONS

This application claims priority to and incorporates fully by reference U.S. Provisional Patent Application No. 62/659,484 filed on Apr. 18, 2018 entitled Machine and Process for Decorticating Plant Matter and having the same inventor as the present application.

BACKGROUND

The stalks of the Hemp plant and other plants contain bast fibers that when removed from the plants can be used to produce textiles and other industrial and consumer goods. Within recent years federal laws have changed making the cultivation of the hemp plant legal.

However, to make use of the desirable bast fibers, they must be removed from the remainder of the stalk, and more particularly, the stalk's hurd. Unfortunately, prior art machinery to accomplish this task, also known as a decorticator, were designed nearly one hundred years ago and before, and accordingly, do not take advantage of modern materials, modern design, and modern manufacturing technology. Prior art machinery is very expensive and because of this as well as the machinery's size and weight, it is ill-suited to use by smaller producers.

DETAILED DESCRIPTION

Figure 1:
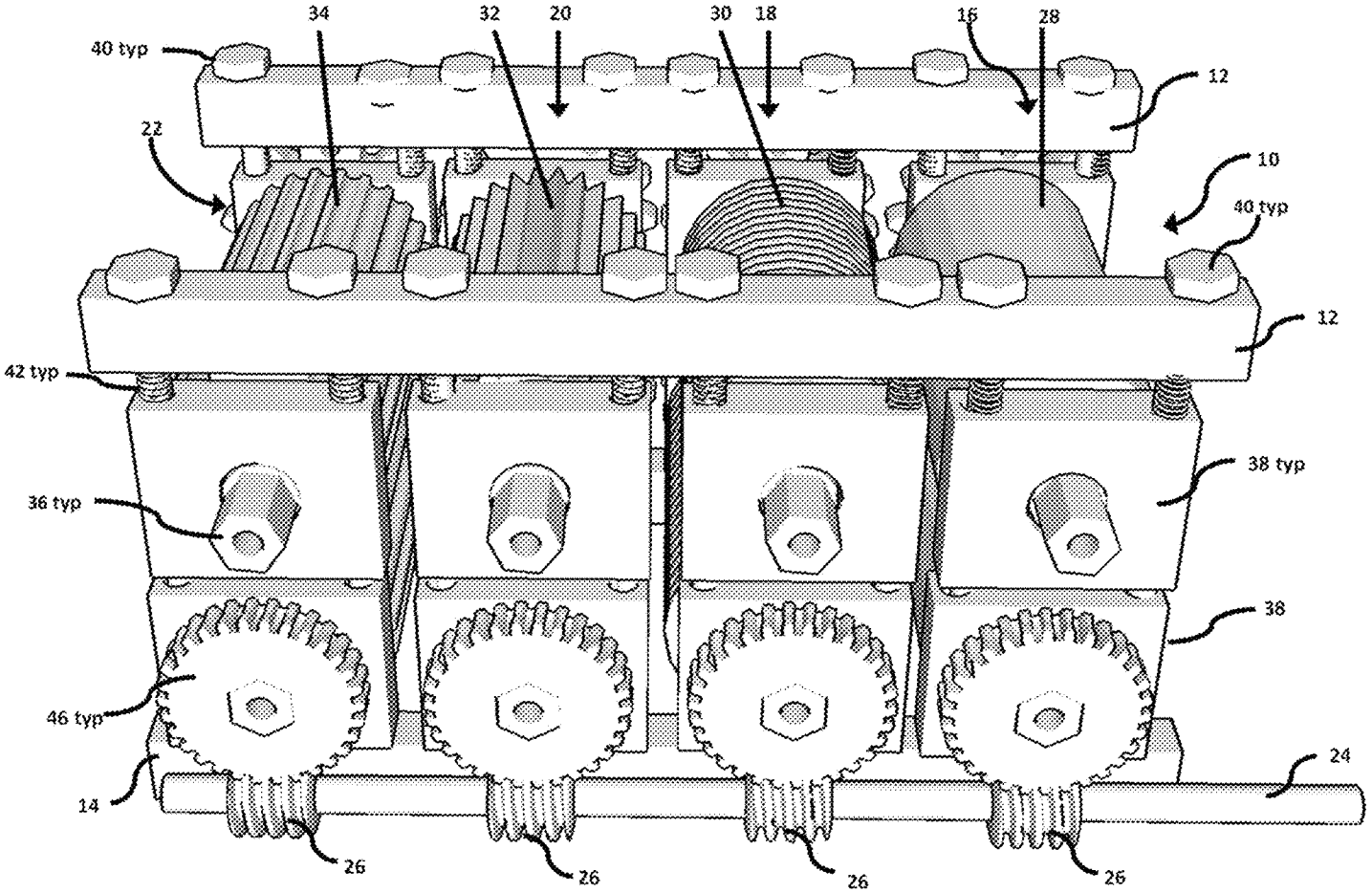
FIG. 1 is a left side perspective view of a decorticating machine according to a first embodiment of the present invention.

A modular decorticating machine (or decorticator) is described.

Embodiments of the machine comprise modular drum assemblies of different tooth and surface patterns that are installed between pairs of left and right, lower and upper rails. The modular drum assemblies (usually provided in upper and lower drum pairs) and the number thereof can be chosen based on the particulars of the type of stalk being processed. One embodiment described herein comprises four drum assemblies; wherein another embodiment utilizes ten drum assemblies of which three comprise comb drum assemblies. However, the embodiments shown herein are not to be considered limiting. In fact, an end user may find a particular configuration that that works best through experimentation on specific types of stalks.

The drum assemblies each typically include: (1) upper and lower drums having a specific surface tooth pattern depending on the specific operation to be performed by the pair; (2) left and right bearing shafts for each drum that are received in the associated drum along the drum's longitudinal axis; left and right bearing blocks for each drum that include a bearing bore in which a bearing surface of associated bearing shaft is rotationally received, (3) a pair of securing bolts that pass through bores in bearing blocks as well as bores in associated rail pairs to secure the bearing block and accordingly the drum assembly to the rails; (4) a pair of coil springs or elastomeric polymer springs/bumpers for biasing the upper and lower drums against each other; and (5) appropriate gears and/or pulleys attached to the ends of the bearing shafts to facilitate the rotational movement and operation of the drum assemblies and the machine.

The rails typically comprise elongated metal (typically steel or aluminum) members, such as a rectangular tubing or C-section. The length can vary depending on the number of drum assemblies that are going to be attached to the rails. Along their length, the rails include bore holes spaced to align with the associated bores in the bearing blocks that are configured to receive the securing bolts therethrough. The bores of the bottom rails may also be threaded or have threaded nuts secured thereto to threadably receive the threaded ends of the bolts therein.

In addition to the rails and drum assemblies, additional gears, pulleys, belts and motors are typically provided to facilitate the rotational and operational movement of the various components. In some embodiments, one or more pulley wheels are attached to one or both the bearing shafts of the lower drums and are operationally connected by one or more belts. One of the belts is further coupled to an electric motor to drive the bottom drums. Spur gears are typically provided on the ends of bearing shafts on one side of the machine that operatively couple the upper drums to the lower drums allowing them to turn in unison albeit opposite rotational directions. In yet other embodiments of the decorticator, one of the drums may further include a hub motor, which acts to drive the associated drum as well as the other drums connected to it by way of pulleys wheels or gears.

While the various components of the drum assemblies can be made using any suitable materials and any manufacturing means, in some embodiments the drums, bearing shafts and/or bearing blocks can be cast injection molded or 3D printed using reinforced or unreinforced plastics. The use of plastic components in contrast to machined and forged metal components greatly reduces the cost and weight of the machine. Further, 3d printing allows replacement parts to be quickly fabricated as needed, and further permits design changes, such as modification of the teeth comprising a drum to accommodate the particularities of a certain type of stalk, to be easily implemented.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The terms "approximately" and "substantially" as used in this specification and appended claims, refers to plus or minus 10% of the value given.

The terms "about" and "generally" as used in this specification and appended claims, refers to plus or minus 20% of the value given.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

A First Embodiment Decorticating Machine

Figure 2:
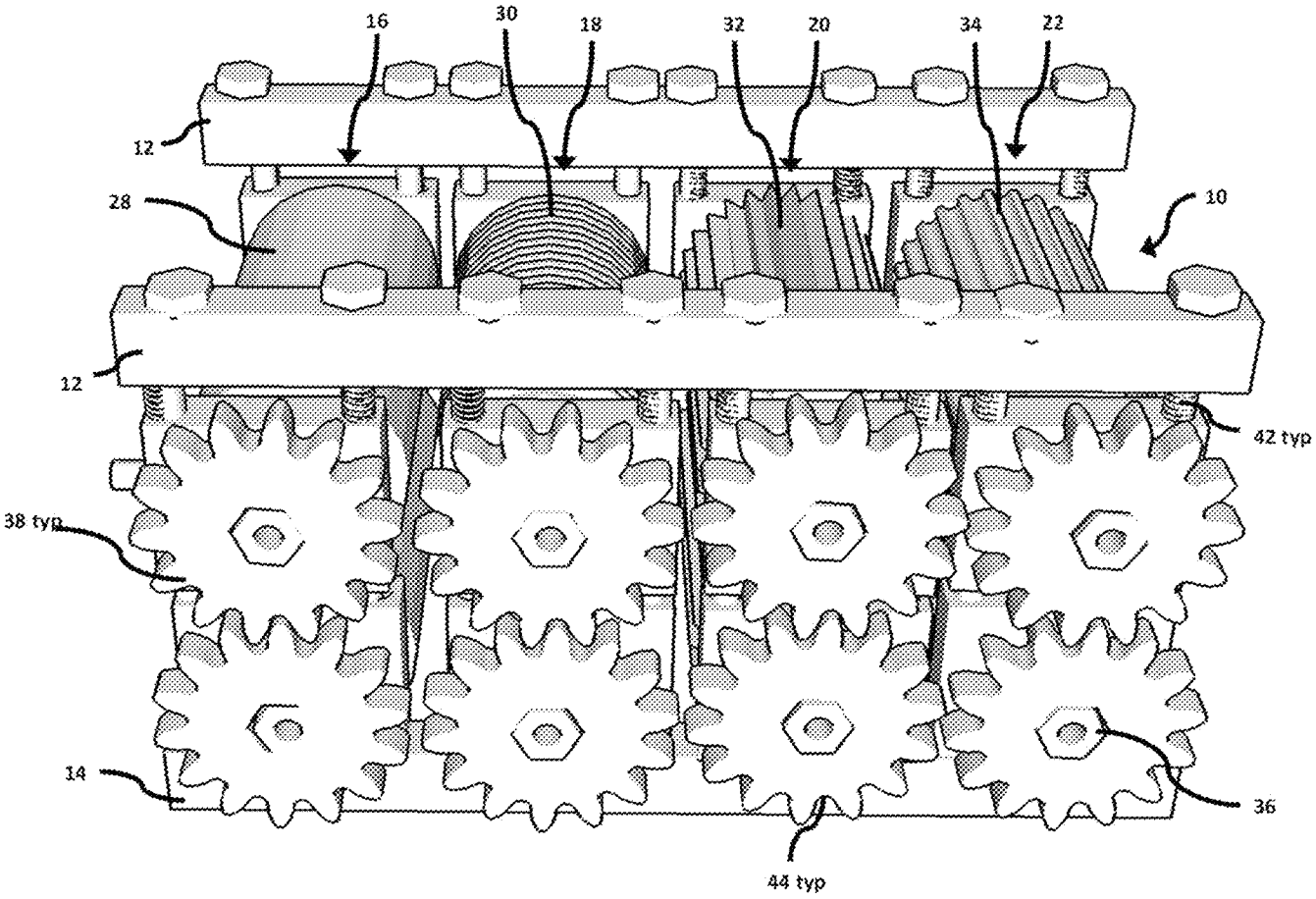
FIG. 2 is a right side perspective view of the decorticating machine according to the first embodiment of the present invention.
Figure 3:
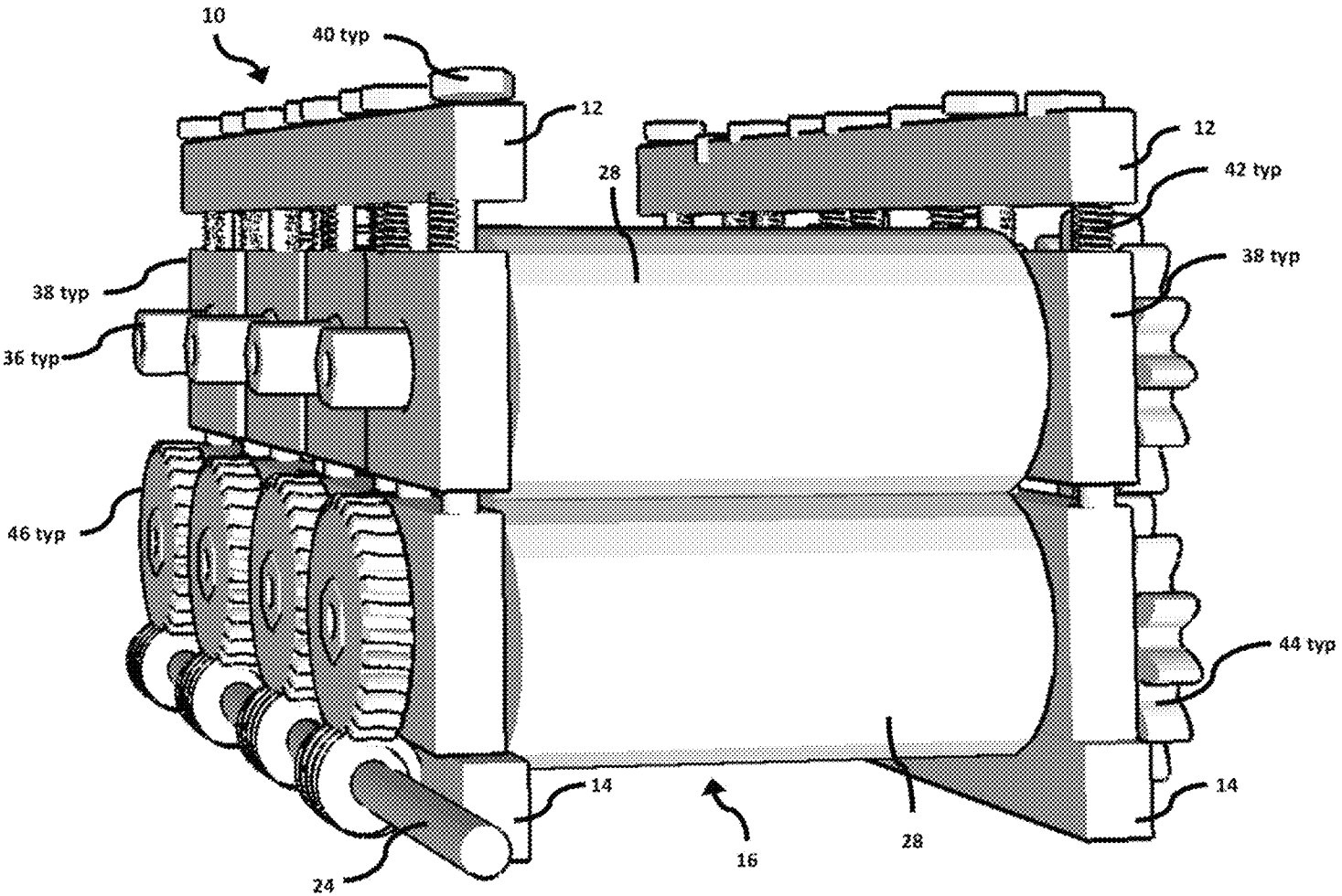
FIG. 3 is a front side perspective view of the decorticating machine according to the first embodiment of the present invention.

A first embodiment of a decorticating machine 10 is illustrated in FIGS. 1-3. The embodiment comprises: a pair of upper rails 12, a pair of lower rails 14, four drum pair assemblies 16-22, and a drive shaft 24 with worms 26 received thereon.

Figure 6:
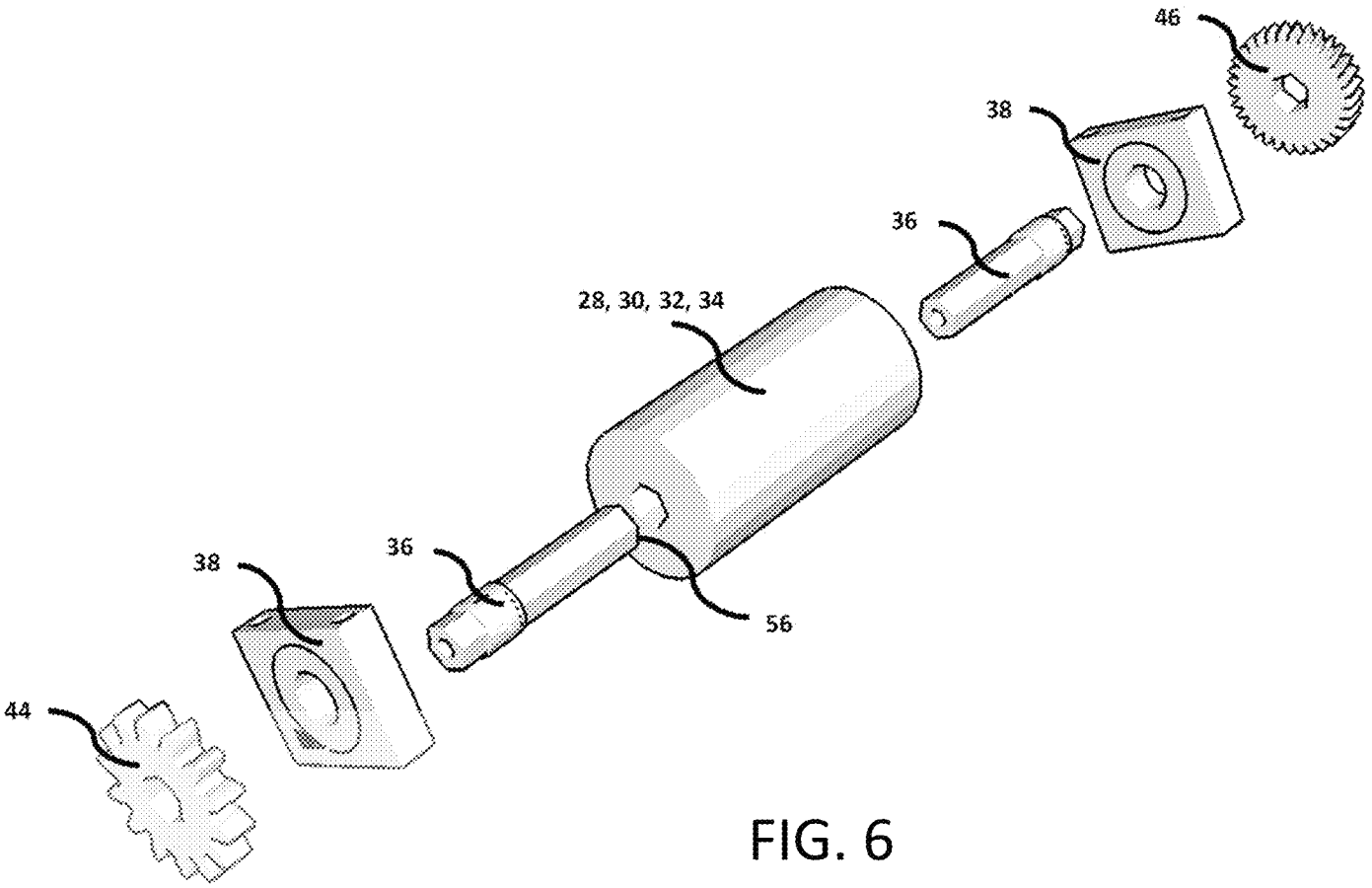
FIG. 6 is an exploded perspective view of a drum subassembly according to an embodiment of the present invention.

Each drum assembly 16-22 comprises: a matching pair of drums 28 to 34; a pair of bearing shafts 36 (also referred to as "36 typ" in the drawings to indicate the indicated bearing shafts are typical) associated with each drum; a pair of bearing blocks 38 also referred to as "38 typ" in the drawings to indicate the bearing blocks are typical) associated with each drum; left and right pairs of elongated securing bolts 40 (referred to as "40 typ" in the drawings to indicate the securing bolts are typical); left and right pairs of coil springs 42 (referred to as "42 typ" in the drawings to indicate the coil springs are typical) to press the upper drum against the lower drum with a desired degree of force, upper and lower spur gears 44 (also referred to as "44 typ" in the drawings to indicate the worm gears are typical); and a worm gear 46 (also referred to as "46 typ" in the drawings to indicate the worm gears are typical). FIG. 6 illustrates an exploded view of a drum subassembly of a drum assembly comprising a single drum 28-34 and pairs of associated bearing shafts 36 bearing blocks 38, a spur gear 44, and a worm gear 46 (present only on lower drum subassemblies). A drum pair assembly comprises upper and lower drum subassemblies along with the securing bolts 40 and coil springs 42.

The upper and lower left rails 12*a-b* and the upper and lower left and right rails 12,14 can best be seen in FIGS. 1-3. As indicated above the length of the rails can vary depending on the number of drum assemblies 16-22 and comb assemblies 48,50,52 (see FIG. 4) that are to be utilized in a particular configuration of the decorticator 10. In the first embodiment, the rails are sized to receive four drum assemblies.

The rails 12,14 are typically comprised of metal tubing or metal angle. Metal tubing is shown in the figures although angle having a C-section, L-section or another suitable cross section could be used as well. The rails are typically comprised of either an aluminum or steel alloy although other materials having suitable strength and stiffness, such as a carbon fiber composite, can be used as well. Each rail includes several pairs, four in the first embodiment, of spaced bore holes (in which securing bolts 40 are received in FIGS. 1-3). The lower rails bores may also be threaded to receive and secure the threaded ends of the securing bolts therein. Alternatively, threaded nuts (not shown) that are either contained within or on the surface of the lower rails can be used to secure the securing bolts. The bore hole pairs are further spaced from each other so that the drums of adjacent drum pair assemblies are close together but not in contact with one another.

A drum assembly 16-22, comprises upper and lower drum subassemblies that are operatively coupled together when installed in the decorticator between the pairs of rails 12,14. The essential component of the drum subassembly is the drum 28-34. Except for the smooth drums 28, the drums typically comprises cylindrical member having longitudinally or circumferentially extending rows of outwardly projecting teeth that are distributed on an exterior surface. The number, size, height and shape of the teeth can all vary depending on specific function of the drum. FIGS. 8*a-g* illustrate drums 28-34, 48-54 with different drum configurations that each act differently on a stalk that is passed between an associated pair.

Figure 8A:
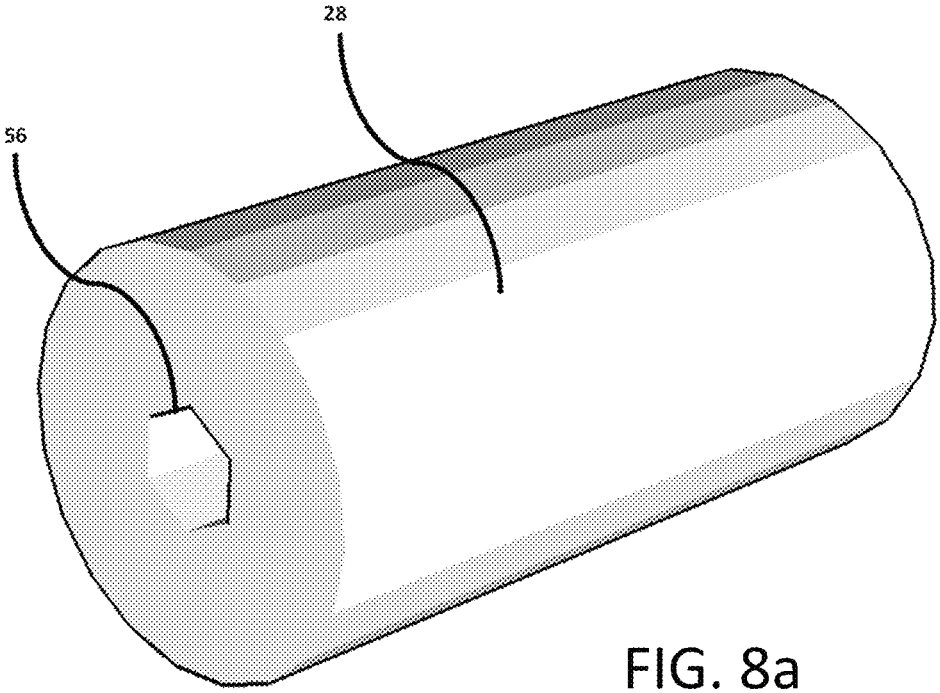
FIGS. 8*a*-8*h* are perspective views of various drums and comb drums for use with the decorticating machine according to embodiments of the present invention.

FIG. 8*a* is an illustration of a smooth roller drum 28. It acts to crush stalks inserted therein as well as grab the stalks and push them forward in the machine 10. It is typically used as part of the initial drum assembly 16 of a machine as well as for feeding the stalks and associated fibers into various comb assemblies.

Figure 8B:
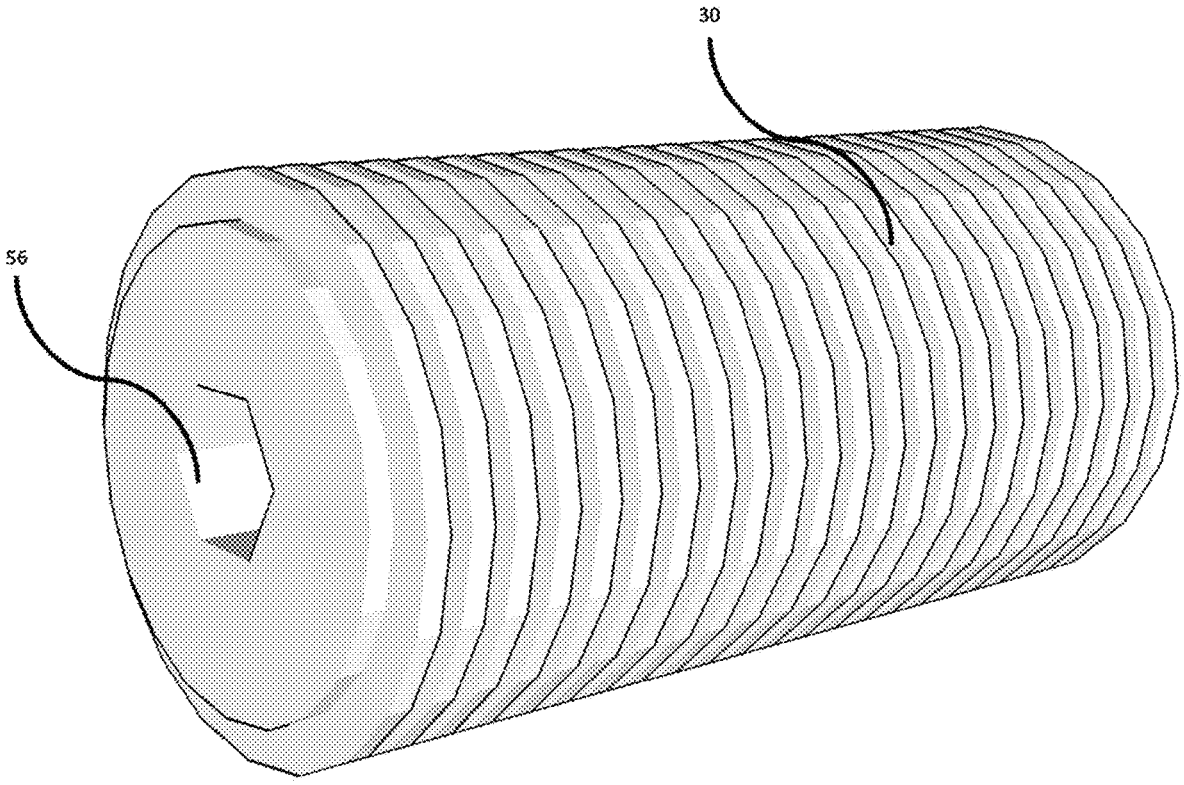

FIG. 8*b* is an illustration of a circumferentially ribbed drum 30. This drums act to split a stalk longitudinally into two or more pieces after it has been flattened.

Figure 8C:
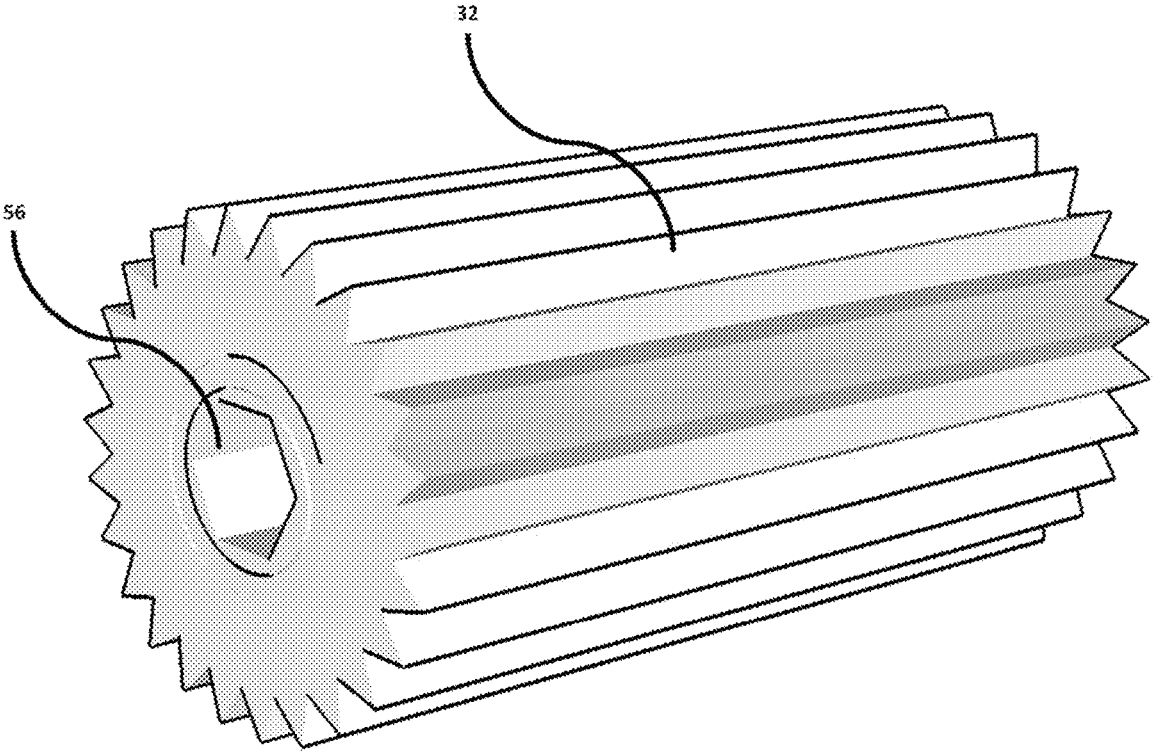

FIG. 8*c* is an illustration of a drum 32 with longitudinally extending spiked teeth. This drum acts to break up the hurd into smaller pieces that can be more easily removed from the fiber.

Figure 8D:
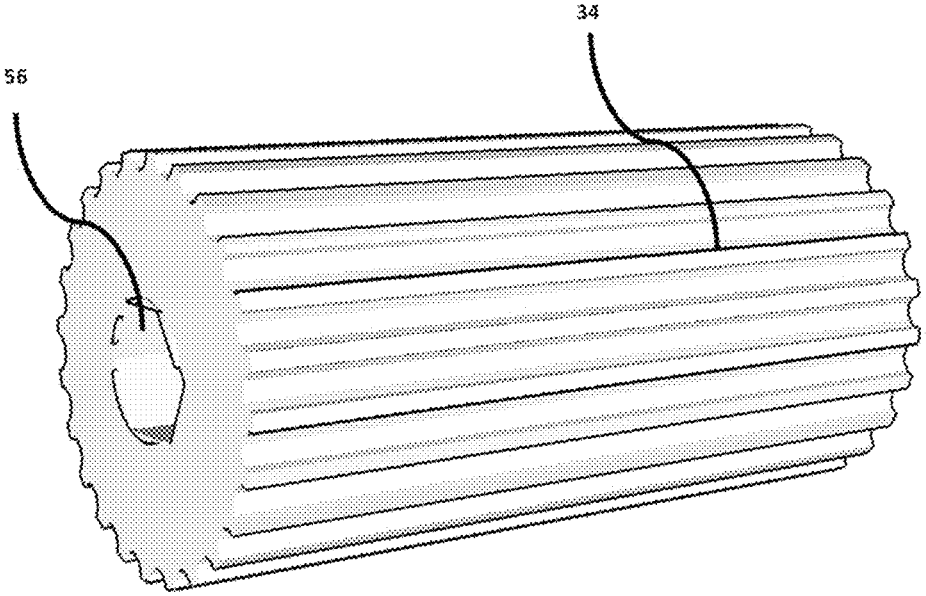

FIG. 8*d* is an illustration of another drum 34 with longitudinally extending teeth. The teeth of this drum, however, has flat peaks instead of spiked peaks. It acts to further break the hurd into smaller pieces as well as separate the hurd pieces from the fiber.

Figure 8E:
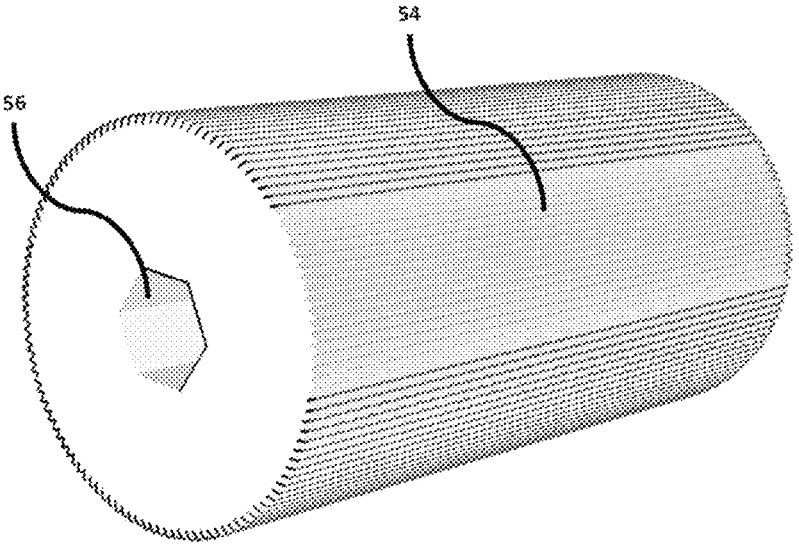

FIG. 8*e* is an illustration of another drum 54 with longitudinally extending teeth. The teeth of this drum are finer than the teeth of the previous drums and act to break the hurd into even smaller pieces. As can be appreciated, the particular configuration of longitudinally toothed drums chosen in processing the stalks of a particular plant material will ultimately depend on the characteristics of the plant. Some plants may respond best with more coarse teeth while others may respond better to drums with finer teeth.

Figure 8F:
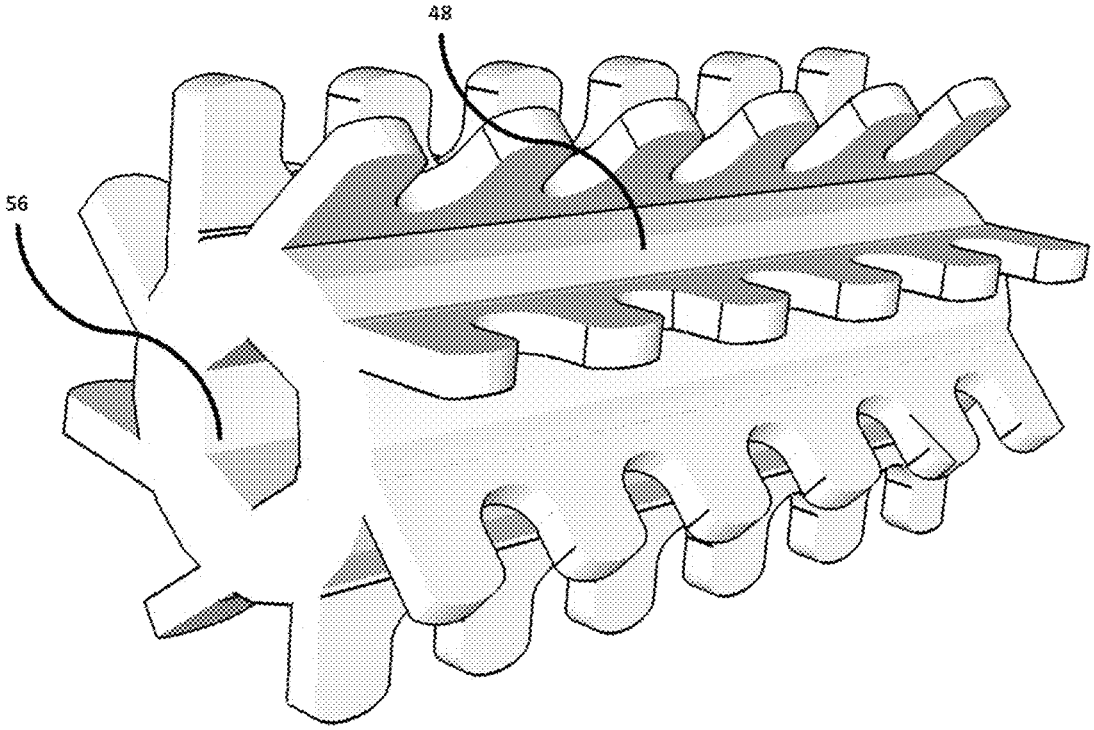
Figure 8G:
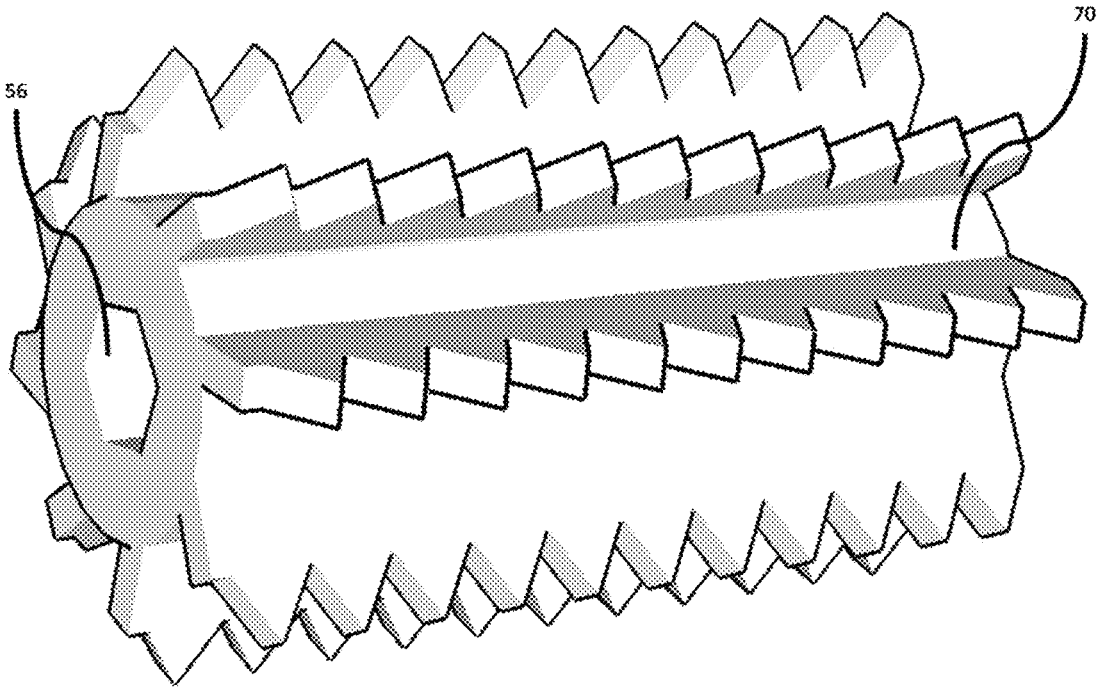
Figure 8H:
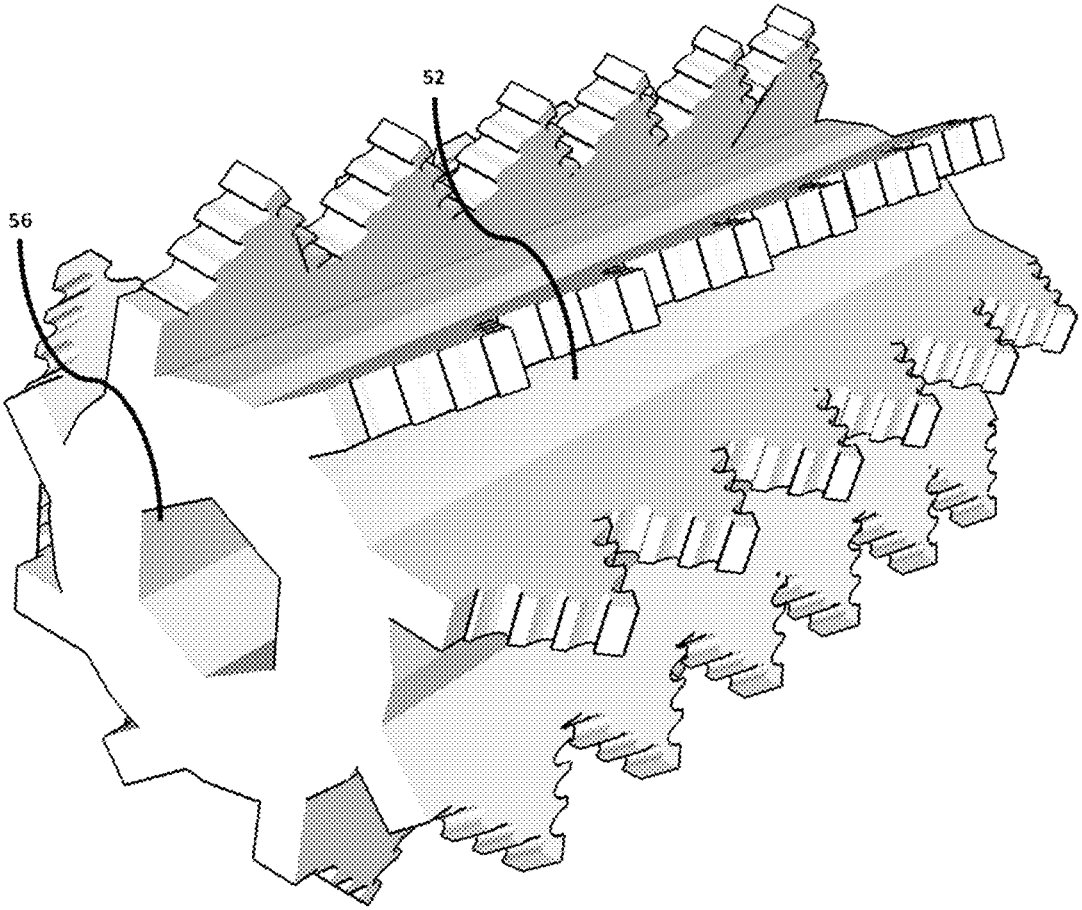

FIGS. 8*f*, 8*g* and 8*h* comprise comb type drums. The configurations of these drums can vary significantly and can be tailored to work with particular types of fiber. The combs act to remove any remaining hurd from the fibers that had not fallen off when passed through the drums with longitudinally extending teeth.

The drums 28-34, 54 and combs-type drums 48-52 can have any suitable effective diameter and length depending on the particulars of the decorticator 10 in which the drum and associated drum assembly is installed. The drum and combs also include a center longitudinal bore 56 in which a bearing shaft 36 can be received and secured. In at least one embodiment, the longitudinal bore has a hexagonal cross section although any suitable shape can be utilized that would facilitate the rotation of the drum in unison with the associated shafts. Other variations are also contemplated wherein the bore cross section can be substantially circular with the drum rotating around a stationary shaft.

The drums 28-34, 48-54 can be manufactured by any suitable means and out of any suitable material; however, in some variations the drums are produced using 3D printing using a suitable reinforced or unreinforced plastic material. For example, a substantially unfilled polyamide material may be suitable as may a polymeric material filled with short carbon fibers to enhance strength and durability. The use of 3D printing may permit an end user to print his/her own drum such as when a replacement is needed. Additionally, the end user may be able to modify the specific configuration of the drum such as the drum's teeth tailoring the drum's functionality for use with the stalk of a particular plant. In some instances, the manufacturer of the decorticator can provide software that permits the user to modify and print drums as necessary.

The drums can be manufactured by other means as well including but not limited to injection molding and casting using a reinforced or unreinforced polymeric material. Drums comprised of metal, such as aluminum or steel alloy, that have been cast, forged, and/or machined are also contemplated.

Figure 7:
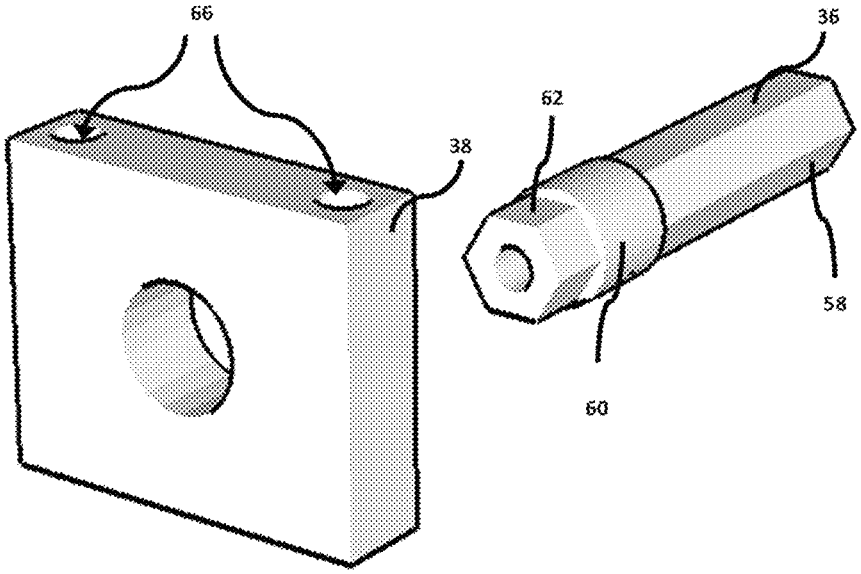
FIG. 7 is a perspective view of a bearing shaft and bearing block according to an embodiment of the present invention.

Associated with each drum 28-34 on the first embodiment machine 10 are a pair of bearing shafts 36 that are typically fixedly received into the ends of the longitudinal bore 56. These shafts serve as axles received in bearing blocks 38 facilitating rotation of the drums during machine operation. Each shaft as best shown in FIG. 7 typically comprises (i) a drum interface portion 58, (ii) a bearing portion 60, and (iii) a drive wheel interface portion 62.

The drum interface portion 58 is adapted to be fixedly and securely received in the longitudinal bore 56 of a drum. As shown the drum interface portion has a hexagonal cross section to match that of the longitudinal bore although other shapes can be used. In some variations, the shaft 36 is slidably received in the bore and can be easily slid there from to facilitate the replacement of the shaft or the drum as necessary. On other variations, the shaft can be one or more of interference fit, bonded or mechanically joined to the drum.

Similar to the drum interface portion, the drive wheel interface 62 portion located on the opposite end of the shaft also typically has a non-circular cross section so that it may fixedly receive a center bore of a spur or worm gear over it.

In-between the drum and drive gear interface portions is the bearing portion 60. Unlike the other portions, it has a circular cross section to facilitate rotational movement in a round bore 64 of the bearing block. The surface of the bearing portion is typically smooth to minimize rotational friction and heat generation.

The bearing shaft 36 can be made of any suitable material but in at least one embodiment the shaft is comprised of a polymeric material. Like the drum, the shaft can be 3D printed from a suitable filled or unfilled polymeric material. Typically to reduce friction during rotation, the polymeric material comprising the shaft can be filled with carbon particulate, short carbon fibers and/or another suitable filler to provide a solid lubrication of the shaft's bearing portion's surface. The shaft can also be cast or injection molded. When comprised of a metal material, the shaft can be cast, forged or machined. In some variations utilizing a plastic shaft, a metal bearing sleeve can be fitted over the bearing portion to provide a more heat resistant surface that can receive liquid lubricants.

The bearing block 38 serves two primary purposes: to provide a stationary bearing surface against which the drum through its bearing shafts 36 can rotate freely during operation and to secure the associated drum subassembly to the decorticating machine 10. The bearing block typically comprises a rectangular block having a center bore 64 in which a bearing portion of a bearing shaft is received. Further, the block includes two spaced substantially vertical bores 66 that extend from a top surface of the block through to a bottom surface of the block. When assembled into a decorticator, a bottom surface of lower bearing block of the lower drum subassembly on each of the left and right sides of the machine generally rests on the top surface of the bottom rail 14; whereas, an upper bearing block of the associated drum assembly is located above the lower bearing block and underneath the upper rail 12 with the associated securing bolts 40 running through the upper rail, the upper block, the lower block and the bottom rail respectively.

Like the drum and bearing shaft, the bearing block 38 can be 3D printed. Because the block contains a bearing surface in the center bore 64 that interfaces with the bearing portion 60 of the bearing shaft 36, the polymeric material comprising the shaft can be filled with carbon particulate, short carbon fibers and/or another suitable filler to provide a solid lubrication.

The block can also be cast or injection molded. When comprised of a metal material, the block can be cast, forged or machined.

In some variations utilizing a plastic bearing block 38, a metal bearing sleeve can be fitted inside of the center bore 64 to provide a more heat resistant surface that can receive liquid lubricants. In other variations, the bearing block's center bore and the bearing portion of the bearing shaft 36 can be sized and configured to receive a suitably sized cartridge bearing. The cartridge bearing can be interference fit or otherwise secured to the bearing block.

As indicated above, the drum assembly 16-22 comprising upper and lower drum subassemblies is secured to the upper and lower rails 12,14 by way of the left and right pairs of securing bolts 40. Pair of left and right coil springs 42 are provided and are received over the securing bolts between the top surface of an upper bearing block and the lower surface of an upper rail. These spring pairs act to bias the upper drum against the lower drum but permit upwardly movement as stalks of plant material are passed between the respective drums. As can be appreciated, the strength of the coil springs can be varied as desired to accommodate different types of plant material and more effectively perform the desired operation on the stalks. Alternatively, elastomeric springs/bumpers comprised of a suitable polymer can be inserted between the upper bearing block and the top rail to perform the same function as coil springs.

As illustrated in FIGS. 1-3, the first embodiment decorticator 10 comprises four drum assemblies 16-22 aligned with each other to define a generally horizontal path between the respective upper and lower drums of each of the drum assemblies for the stalks being processed. The lower drums of each assembly are driven by a worm gear 46 that is attached to the end of the bearing shaft 36 and is meshed with an associated worm 26 that is operatively coupled to a drive motor (not shown) by way of a shaft 24 on which the worm is secured. With reference to FIG. 2, each of the ends of the bearing shafts on the opposing side of the machine include spur gears 44 with the lower spur gears interfacing with the upper spur gears to drive the upper drums of each drum assembly at a similar rotational rate as the lower drum but in the opposite rotational direction.

The specific gearing and mechanisms for driving the drums can vary substantially and significantly from the illustrated embodiment. In some variations belts and pulleys can be utilized to drive the drums in some variations, such as the drums having longitudinally extending teeth, the lower drum meshes with and drives the upper drum obviating the need for intermeshing gears for this purpose on the ends of the bearing shafts. In yet another variation, a motor is located within the drum of one or more of the drum assemblies obviating the need for an external motor.

As shown, the first embodiment decorticator includes a first drum assembly 16 comprising a pair of smooth roller drums 28 that crush or smash the plant stalks flat. The second drum assembly comprises circumferentially ribbed drums 30 that act to split the flattened stalks. The third drum assembly comprises a first rotating pair of spiked drums 32 having course longitudinally extending teeth that act to break up the non-fibrous hurd of the stalk. The fourth and final drum assembly also comprises a drum 34 having longitudinally extending teeth with flat peaks that further break and separate the hurd from the bast fibers. As can be appreciated, the configuration of drum assemblies is merely exemplary and can be varied as desired to accommodate different types and sizes of stalks. Given the ease of manufacturing the drums, such as by 3d printing, a user may customize the type and order of drum assemblies to most efficiently and most effectively separate the fibers from the remainder of the stalk.

A Second Embodiment Decorticating Machine

Figure 4:
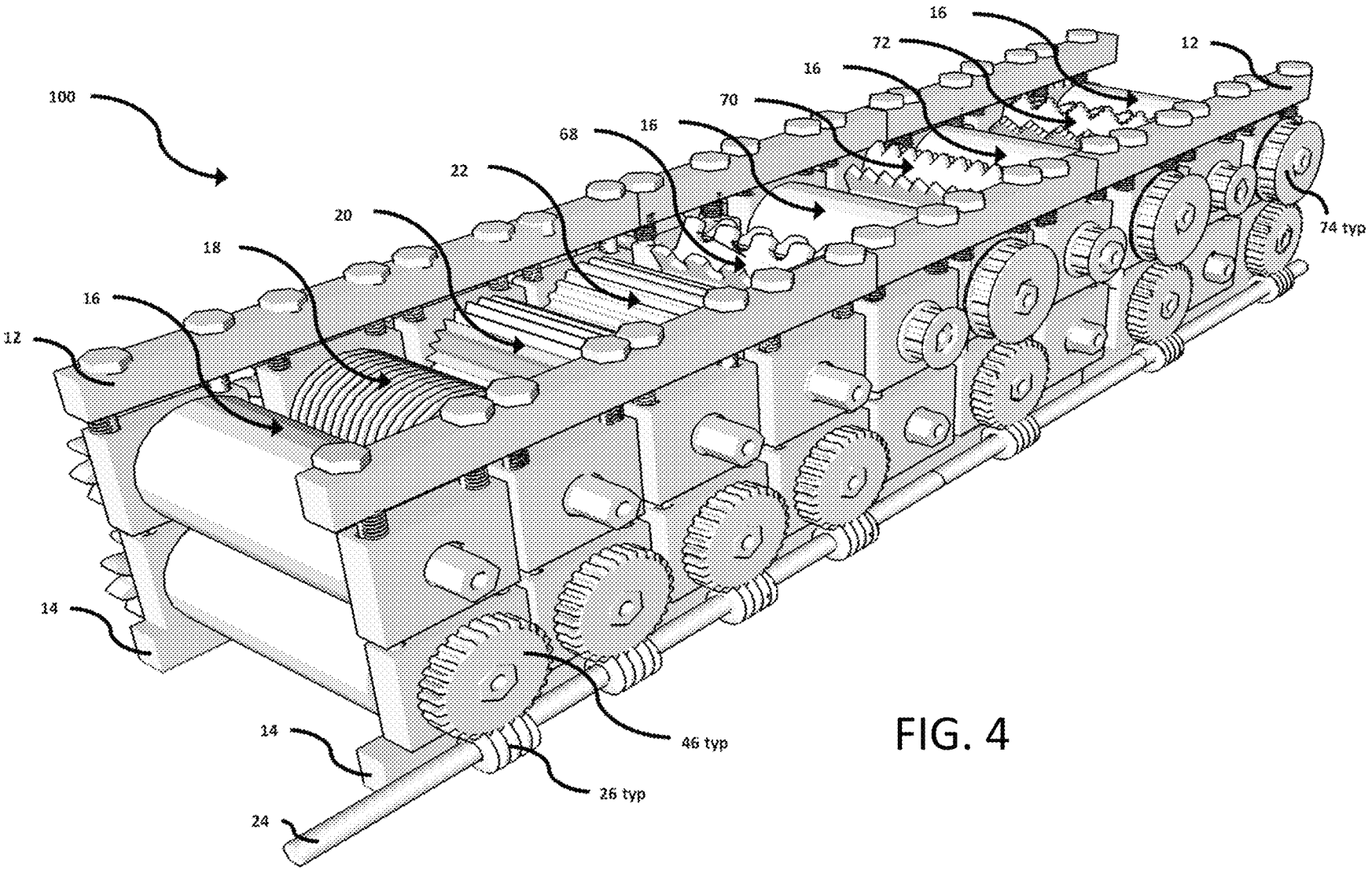
FIG. 4 is a front side perspective view of a decorticating machine according to a second embodiment of the present invention.
Figure 5:
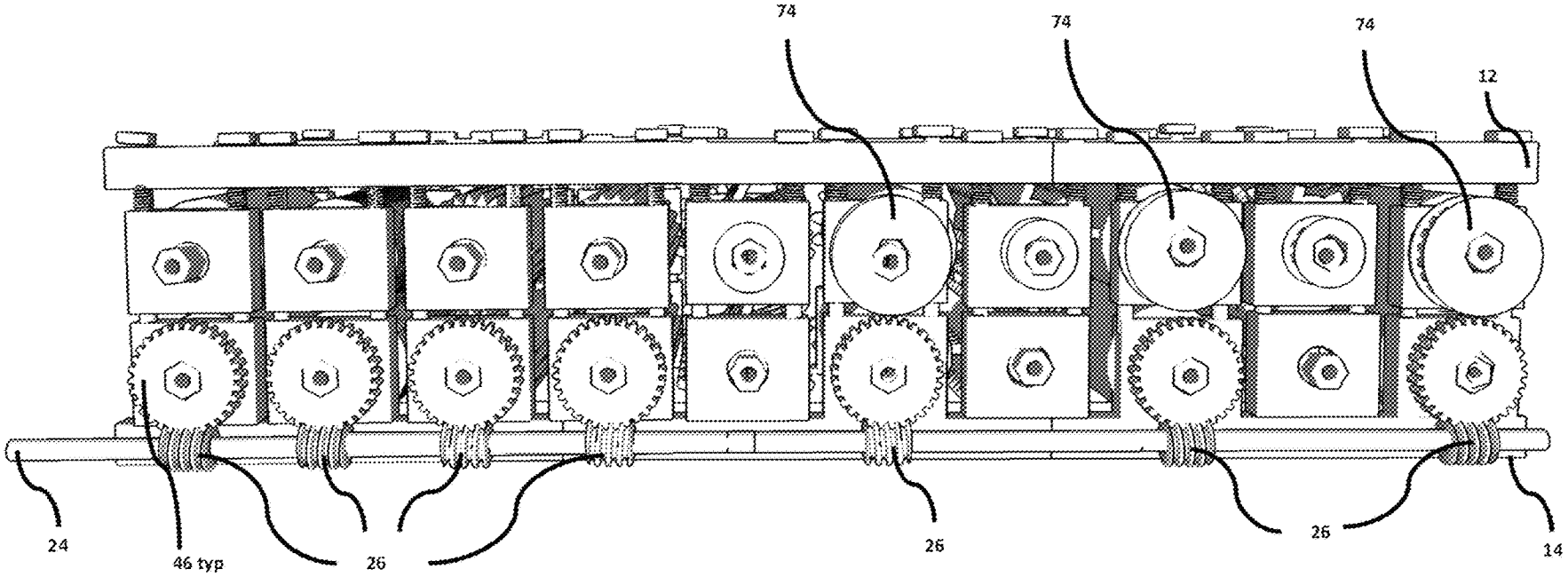
FIG. 5 is a right side view of the decorticating machine according to the second embodiment of the present invention.

FIGS. 4 and 5 illustrate a second embodiment decorticating machine. This machine is similar to the first embodiment except it comprises longer rails 12, 14 that include an additional six drum assemblies including three comb drum assemblies 68,70,72. As can be appreciated other embodiments are also known having any suitable number of drum and comb assemblies. In the illustrated embodiment, the first four drum assemblies are the same as in the first embodiment. The additional drum and comb assemblies comprise three undriven comb drum assemblies 68-72 and three roller drum assemblies 16 used to push and pull the bast fibers through the combs. The various comb drum assemblies are substantially similar to the drum assemblies except for the configuration of the drums, which typically comprise a plurality of individual teeth as opposed to continuous longitudinal or circumferential teeth found on some of the other drums. The comb drum assemblies act to separate any non-fiber remnants from the bast fibers. After passing through the combs the fibers are ideally ready for spinning into twine or yarn for subsequent use in fabricating rope or weaving fabric.

Also with reference to FIGS. 4 & 5, an alternative means of driving the upper drum in a particular drum assembly is shown in relation to the three roller drum assemblies. As shown, the worm gear 46 of each assembly not only interfaces with a drive worm 26 but also interfaces with a meshing gear 74 also referred to as "74 typ" in the drawings to indicate the meshing gears are typical) on its top side. The meshing gear is coupled to the end of the bearing shaft of the associated upper drum subassembly.

A Method of Fabricating and Assembling an Embodiment of a Decorticating Machine

As indicated above, the various components of the drum assemblies 16-22, 68-72 can be fabricated by any suitable means, but in at least some embodiments, one or more of the bearing shafts, the bearing blocks, the drums and various gears are fabricated using a 3D printer. Any suitable polymeric materials can be used in the fabrication. In some variations, the polymeric materials are reinforced with short fiber fiberglass and/or carbon fiber. In other variations, additives such as carbon black may be incorporated into the polymeric material to provide a dry lubrication to the bearing surfaces on the bearing shaft and the bearing block.

3D printing fabrication permits an end user with the appropriate file to print his/her own replacement parts as necessary provided he/she has a suitable 3D printer limiting down time in case of a failure of one or more of the machine's components. Furthermore, a user may be able to modify a particular component, such as the drum, to accommodate the particularities of the plant material being processed. Accordingly, the configuration of a resulting machine can be customized for maximum efficiency, effectiveness and utility.

Even when the end user does not have access to a printer, he/she can potentially easily order a replacement part from the manufacturer who can print it on demand even to the particular specifications of the user. In some embodiments, a user may be able to modify a CAD file to his/her particular configuration and submit it to the manufacturer over the Internet for fabrication.

The construction and assembly of a decorticating machine 10, 100 can be relatively straight forward and simple. First, the number and type of drum and comb assemblies the machine will require are determined which dictates the length of rails required as well as the location of the bore pairs in each rail to mount the assemblies thereto.

In one method of assembly, such as can pertain to the assembly of the first embodiment of FIGS. 1 & 2, the various securing bolts pairs 40 are inserted into bores of the top rail 12. The top rails are placed inverted on a horizontal surface so the bolts are extending generally vertically upwardly with the left and right top rails positioned parallel to each other but spaced apart.

Coil springs 42 are placed over the bolts and then preassembled upper drum subassemblies are then lowered over the bolt pairs. After the upper drum subassemblies have been placed the corresponding preassembled lower drum assemblies are lowered in place over the bolts. Finally, the lower rails 14 are threadably secured to the ends of the bolts. The machine is flipped over and final tightening of the bolts is performed. The bore holes in the lower rail can be threaded. For instance, if the lower rail is 3D printed of carbon fiber polymers, threaded bore holes can be printed into the rail.

Although not shown, in some embodiments cross bars may also be specified to couple the left and right rails together and create a more rigid framework.

The finished decorticator can also be mounted to a supporting framework or stand, which is typically open so that hurd and other parts of the stalk removed from the fiber during the machines operation can fall to the floor or catch bin(s) located below the machine. Before operation can commence the drive system is coupled with the associated gears of the drum assemblies.

Assembly of the drum subassemblies is best described with reference to FIG. 6. The bearing shafts 36 are secured in the center bore 56 of the associated drum typically by one or both of adhesive bonding and interference fit. The bearing blocks 38 are slid over the ends of the shafts so that the bearing surfaces on both the shafts and the blocks are in contact and alignment with each other. Finally, as applicable, the gears 44, 46 are fitted over the ends of the shafts and also secured in place typically by one or both of adhesive bonding and interference fit.

A Method of Using a Decorticating Machine

Once the decorticator machine 10, 100 is up and running, stalks of a fibrous plant are fed into the machine at the first drum assembly, which as previously described typically comprises smooth rollers that act to pull the stalks into the machine and crush them.

As the stalks proceed through machine, the stalks are crushed, split, and the hurd is broken into pieces. Typically, most if not substantially all of the pieces of hurd separate from the bast fibers and fall downwardly from the machine. With some types of plant material, one or more combing operations may be required to remove the final pieces of hurd. The combing operations can be integrated into the machine as shown in the second embodiment of FIGS. 4 and 5 or the fiber can be separately processed.

The resulting fiber can be used in any suitable manner. For instance, it can be spun into thread or yarn and subsequently used to make fabric or rope. Further, the fibers can be processed to create high strength carbon, which can be used in the fabrication of advanced composite structures.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A decorticating machine, the machine comprising:

left and right top rails, each top rail including at least a first pair and a second pair of spaced top rail holes extending through the top rail;

left and right bottom rails, each bottom rail including at least a first pair and a second pair of spaced bottom rail holes extending through the bottom rail, spacing of the first and second pairs of spaced bottom rail holes being similar to a spacing of the first pair and the second pair of spaced top rail holes; and at least a first drum assembly and a second drum assembly, the first drum assembly having a first upper drum subassembly, a first lower drum subassembly, and first pairs of left and right securing bolts, the first upper drum subassembly including, a first left upper bearing block having a first upper left pair of securing bores, a spacing between the first upper left pair of securing bores being substantially similar to the spacing between the first pair of top rail holes, a first right upper bearing block having a first upper right pair of securing bores, a spacing between the first upper right pair of securing bores being substantially similar to the spacing between the first pair of top rail holes, and a cylindrical first upper drum having a first upper drum exterior surface and a first upper longitudinal axis with the first upper drum being rotatably received between the first left upper bearing block and the first right upper bearing block along the first upper longitudinal axis, the first upper longitudinal axis being substantially orthogonal to the first upper left pair of securing bores, the first lower drum subassembly including, a first left lower bearing block having a first lower left pair of securing bores, a spacing between the first lower left pair of securing bores being substantially similar to the spacing between the first pair of top rail holes, a first right lower bearing block having a first lower right pair of securing bores, a spacing between the first lower right pair of securing bores being substantially similar to the spacing between the first pair of top rail holes, and a cylindrical first lower drum having a first lower drum exterior surface and a first lower longitudinal axis with the first lower drum being rotatably received between the first left lower bearing block and the first right lower bearing block along the first lower longitudinal axis, the first lower longitudinal axis being substantially orthogonal to the first lower left pair of securing bores, the second drum assembly having a second upper drum subassembly, a second lower drum subassembly, and second pairs of left and right securing bolts, the second upper drum subassembly including, a second left upper bearing block having a second upper left pair of securing bores, a spacing between the second upper left pair of securing bores being substantially similar to the spacing between the second pair of top rail holes, a second right upper bearing block having a second upper right pair of securing bores, a spacing between the second upper right pair of securing bores being substantially similar to the spacing between the second pair of top rail holes, and a cylindrical second upper drum having a second upper drum exterior surface and a second upper longitudinal axis with the second upper drum being rotatably received between the second left upper bearing block and the second right upper bearing block along the second upper longitudinal axis, the second upper longitudinal axis being substantially orthogonal to the second upper left pair of securing bores, the second lower drum subassembly including, a second left lower bearing block having a second lower left pair of securing bores, a spacing between the second lower left pair of securing bores being substantially similar to the spacing between the second pair of top rail holes, a second right lower bearing block having a second lower right pair of securing bores, a spacing between the second lower right pair of securing bores being substantially similar to the spacing between the second pair of top rail holes, and a cylindrical second lower drum having a second lower drum exterior surface and a second lower longitudinal axis with the second lower drum being rotatably received between the second left lower bearing block and the second right lower bearing block about the second lower longitudinal axis, the second lower longitudinal axis being substantially orthogonal to the second lower left pair of securing bores;

wherein the first drum assembly is secured to (i) the left top and bottom rails by way of the first pair of left securing bolts received through the first pair of spaced top rail holes, the first upper left pair of securing bores, the first lower left pair of securing bores, and the first pair of spaced bottom rail holes, (ii) the right top and bottom rails by way of the first pair of right securing bolts received through the first pair of spaced top rail holes, the first upper right pair of securing bores, the first lower right pair of securing bores, and the first pair of spaced bottom rail holes; and wherein the second drum assembly is secured to (i) the left top and bottom rails by way of the second pair of left securing bolts received through the second pair of spaced top rail holes, the second upper left pair of securing bores, the second lower left pair of securing bores, and the second pair of spaced bottom rail holes, (ii) the right top and bottom rails by way of the second pair of right securing bolts received through the second pair of spaced top rail holes, the second upper right pair of securing bores, the second lower right pair of securing bores, and the second pair of spaced bottom rail holes.

2. The decorticating machine of claim 1, wherein the first upper drum, the first lower drum, the second upper drum, and the second lower drum are comprised of a polymeric material.

3. The decorticating machine of claim 2, wherein the polymeric material is partially filled with a reinforcing fiber.

4. The decorticating machine of claim 2, wherein the first upper drum, the first lower drum, the second upper drum, and the second lower drum are manufactured by a 3D printing process.

5. The decorticating machine of claim 1, wherein the first left lower bearing block, the first right lower bearing block, the first left upper bearing block, the first right upper bearing block, the second left lower bearing block, the second right lower bearing block, the second left upper bearing block, the second right upper bearing block are comprised of a polymeric material.

6. The decorticating machine of claim 5, wherein the polymeric material is partially filled with a reinforcing fiber.

7. The decorticating machine of claim 5, wherein the first left lower bearing block, the first right lower bearing block, the first left upper bearing block, the first right upper bearing block, the second left lower bearing block, the second right lower bearing block, the second left upper bearing block, the second right upper bearing block are manufactured by a 3d printing process.

8. The decorticating machine of claim 1, wherein the first drum assembly comprises at least one left biasing spring and at least one right biasing spring, the at least one left biasing spring being located between the left top rail and the first left upper bearing block, the at least one right biasing spring being located between the right top rail and the first right upper bearing block, the at least one left and at least one right biasing springs acting to bias the first upper drum subassembly against the first lower drum assembly.

9. The decorticating machine of claim 8, wherein the at least one left biasing spring and the at least one right biasing spring each comprise an elastomeric material.

10. The decorticating machine of claim 1, wherein the first drum assembly comprises first and second left coil springs and first and second right coil springs, the first and second right coil springs being received over the first pair of right securing bolts between the right top rail and the first right upper bearing block, the first and second left coil springs being received over the first pair of securing bolts between the left top rail and the first left upper bearing block, wherein the first and second left and right coil springs act to bias the first upper drum subassembly against the first lower drum assembly.

11. The decorticating machine of claim 1, wherein (a) the first upper drum includes an upper axial center bore, (b) the first left upper bearing block and first right upper bearing block comprise left and right upper center bores respectively, and (c) the first upper drum subassembly further comprises left and right upper bearing shafts, the left and right upper bearing shafts being fixedly received in respective left and right ends of the upper axial center bore, and rotationally received in the respective left and right upper center bores.

12. The decorticating machine of claim 11, wherein the left and right upper bearing shafts are comprised of a polymeric material.

13. The decorticating machine of claim 12, wherein the polymeric material is filled with one or both of a reinforcing fiber and a dry lubricant.

14. The decorticating machine of claim 11, wherein the interfaces between the respective left and right upper bearing shafts and the left and right upper center bores comprise a solid bearing.

15. The decorticating machine of claim 11, wherein (a) the first lower drum includes a lower axial center bore, (b) the first left lower bearing block and first right lower bearing block comprise left and right lower center bores respectively, and (c) the first lower drum subassembly further comprises left and right lower bearing shafts, the left and right lower bearing shafts being fixedly received in respective left and right ends of the lower axial center bore, and rotationally received in the respective left and right lower center bores.

16. The decorticating machine of claim 15, further comprising at least first upper and first lower spur gears, the first lower spur gear secured to an end of the right lower bearing shaft and the first upper spur gear secured to an end of the right upper bearing shaft, wherein teeth of the respective spur gears intermesh.

17. The decorticating machine of claim 16, wherein the at least first upper and first lower spur gears are comprised of a polymeric material.

18. The decorticating machine of claim 16, wherein further comprising a drive gear, the drive gear being secured to an end of the left lower bearing shaft, the drive gear comprising one of a worm gear, a pulley or a spur gear.

19. The decorticating machine of claim 1, wherein the first upper drum exterior surface and the first lower drum exterior surface are substantially similar.

20. The decorticating machine of claim 1, wherein the first upper drum exterior surface comprises one of a substantially smooth surface, a plurality of circumferentially extending teeth, a plurality of longitudinally extending teeth, and a plurality of distinct teeth.

* * * * *